US007444978B2

(12) United States Patent
Budde-Gottschalk et al.

(10) Patent No.: US 7,444,978 B2
(45) Date of Patent: Nov. 4, 2008

(54) ADJUSTING DEVICE, IN PARTICULAR FOR A MOTOR VEHICLE

(75) Inventors: Ansgar-Maria Budde-Gottschalk, Berlin (DE); Thomas Fischer, Ludwigsfelde (DE); Tilo Koch, Jembke (DE); Holger Rudzinski, Berlin (DE); Marco Ruppel, Bochow (DE)

(73) Assignee: Daimler AG, Stuttgart (DE)

( * ) Notice: Subject to any disclaimer, the term of this patent is extended or adjusted under 35 U.S.C. 154(b) by 27 days.

(21) Appl. No.: 11/707,771

(22) Filed: Feb. 16, 2007

(65) Prior Publication Data

US 2007/0234996 A1 Oct. 11, 2007

Related U.S. Application Data

(63) Continuation-in-part of application No. PCT/EP2005/008899, filed on Aug. 16, 2005.

(30) Foreign Application Priority Data

Aug. 17, 2004 (DE) ..... 10 2004 039 713

(51) Int. Cl.
*F01M 1/02* (2006.01)

(52) U.S. Cl. ..... 123/196 S; 123/196 CP; 417/274

(58) Field of Classification Search ..... 123/196 S, 123/196 CP, 196 R, 90.33; 417/274, 213, 417/220, 218; 418/26
See application file for complete search history.

(56) References Cited

U.S. PATENT DOCUMENTS

| | | | | |
|---|---|---|---|---|
| 3,743,445 | A | 7/1973 | Dworak et al. | |
| 2005/0047930 | A1 * | 3/2005 | Schmid | 417/274 |

FOREIGN PATENT DOCUMENTS

| | | |
|---|---|---|
| JP | 62 197 683 | 9/1987 |
| JP | 62 248885 | 10/1987 |
| WO | WO 03/074877 | 9/2003 |

* cited by examiner

*Primary Examiner*—Stephen K. Cronin
*Assistant Examiner*—Hyder Ali
(74) *Attorney, Agent, or Firm*—Klaus J. Bach

(57) ABSTRACT

In an adjusting device, in particular for a motor vehicle, which includes at least one adjusting unit for adjusting the pressure of a pressure medium in accordance with at least one parameter, the adjusting unit includes a first and a second throttle point having different dependences on the parameter in order to obtain a pressure difference dependent on the parameter for controlling the supply of the pressure medium.

6 Claims, 2 Drawing Sheets

ADJUSTING DEVICE, IN PARTICULAR FOR A MOTOR VEHICLE

This is a Continuation-In-Part application of pending International Patent Application PCT/EP2005/008899 filed Aug. 16, 2005 and claiming the priority of German patent application 10 2004 039 713.9 filed Aug. 17, 2004.

BACKGROUND OF THE INVENTION

The invention relates to an adjusting device, in particular for a motor vehicle, including an adjusting unit for adjusting the pressure of a pressure medium depending on at least one parameter.

An adjusting device with an adjusting unit which is provided to adjust the pressure of a pressure medium according to a temperature of the pressure medium is known from JP 62248885 A, Patent Abstracts of Japan. For this purpose the adjusting unit includes a variable limiter formed by a slide, which limiter is controlled via a temperature medium formed by a wax.

It is the object of the present invention to provide an adjusting device which can be implemented using a simple and especially low-cost construction means.

SUMMARY OF THE INVENTION

In an adjusting device, in particular for a motor vehicle, which includes at least one adjusting unit for adjusting the pressure of a pressure medium in accordance with at least one parameter, the adjusting unit includes a first and a second throttle point having different dependences on the parameter in order to obtain a pressure difference dependent on the parameter for controlling the supply of the pressure medium.

The first and second throttle points have different dependences on the parameter, in particular with respect to their throttling effect, whereby an especially simple and lower-cost construction can be achieved, since suitable throttle points can be implemented especially simply and inexpensively.

The two throttle points may be implemented according to different parameters which appear appropriate to a person skilled in the art, for example, according to a speed of an internal combustion engine or according to a torque, etc. However, the parameter is formed especially advantageously by a temperature of the pressure medium, whereby undesired influences of a temperature-dependent viscosity change can be at least reduced. In particular, in an oil circuit of a motor vehicle in operating states with low pressure medium temperatures, undesirably high pressures and associated high power losses can be avoided.

If at least one throttle point is at least a partially integral part of a pump, additional components, complexity of assembly, installation space and cost can be saved. In this context a "pump part" should be understood to mean components which fulfill at least a partial function of a pump, such as an adjusting piston of a pump, a pump housing, etc.

The throttle points, or preferably one of the throttle points, may be adjustable by means of various actuating mechanisms which appear appropriate to a person skilled in the art, for example, an electric, electromagnetic, hydraulic and/or thermal actuator. If the throttle points are formed at least partially from different materials with different coefficients of thermal expansion, and if their different thermal expansions in operation are utilized to obtain the pressure difference, additional components, complexity of assembly, installation space and cost can again be saved.

In a further embodiment of the invention it is proposed that at least one of the throttle points is formed by a bearing gap between two components, whereby a desired temperature dependence can advantageously be achieved in a simple manner, in particular if the components are formed from materials with different coefficients of thermal expansion, and the different thermal expansions are used in operation to obtain the pressure difference. In this case, different material combinations which appear appropriate to a person skilled in the art are possible, such as different combinations of metal, plastics and/or ceramics, etc.

The invention will become more readily apparent from the following description thereof on the basis of the accompanying drawings:

DESCRIPTION OF PARTICULAR EMBODIMENTS

Figure 1:
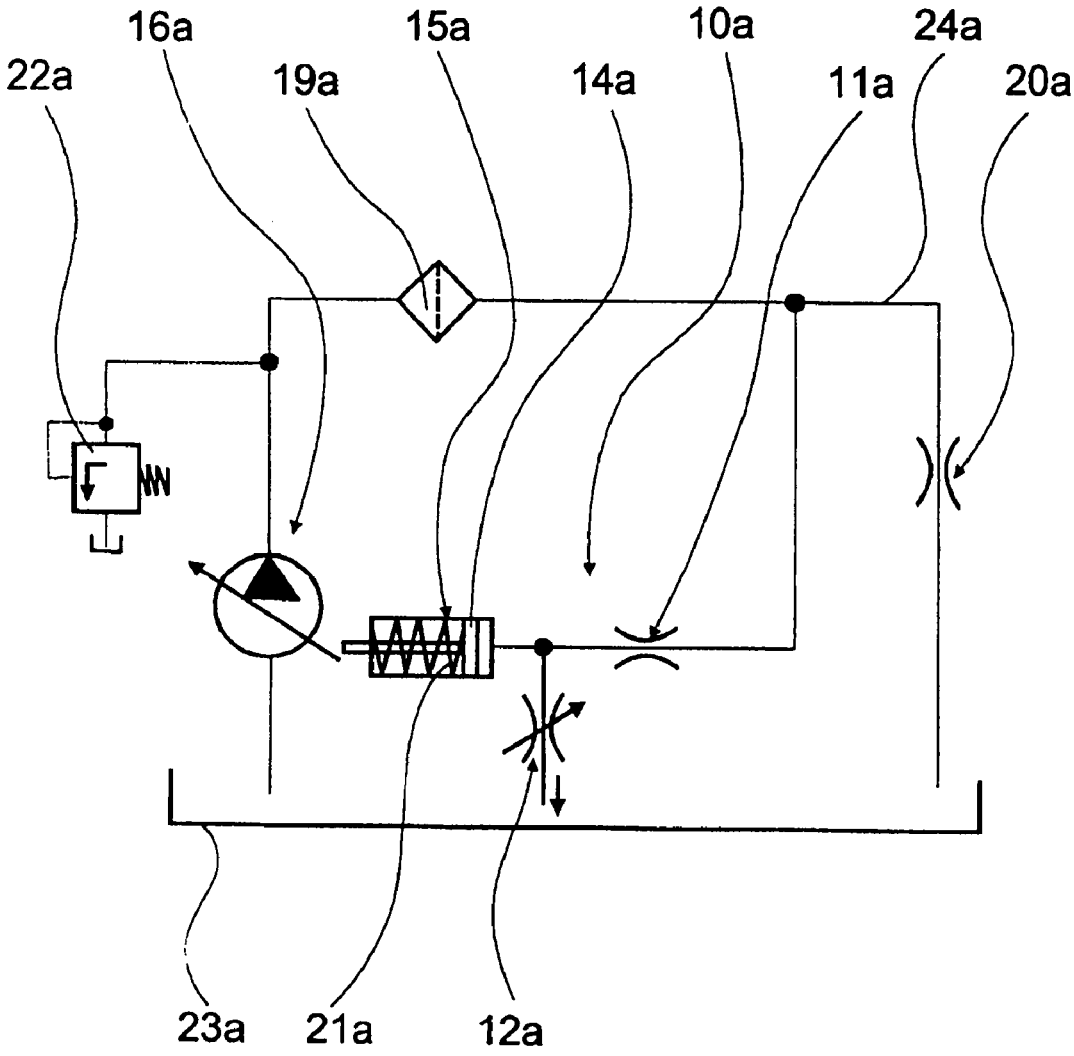
FIG. 1 is a circuit diagram of an oil circuit of an internal combustion engine of a motor vehicle including an adjusting device according to the invention and a pump unit.

FIG. 1 shows a circuit diagram of an oil circuit of an internal combustion engine of a motor vehicle, including an adjusting device according to the invention and a pump unit 16*a*, by means of which consumers 20*a*, such as bearings in a cylinder block/crankcase, crankshaft bearings, a cylinder head, etc., can be supplied via an oil filter 19*a* with a pressure medium formed by an internal combustion engine lubricating oil. The adjusting device comprises an adjusting unit 10*a* which is provided to adjust a pressure of the pressure medium according to a parameter formed by a temperature of the pressure medium in a main oil passage 24*a*. For safety, a pressure relief valve 22*a* is arranged upstream of the oil filter 19*a*.

According to the invention the adjusting unit 10*a* includes two throttle points 11*a*, 12*a* which have different dependences on the parameter in order to obtain a pressure difference dependent on the parameter.

Figure 2:
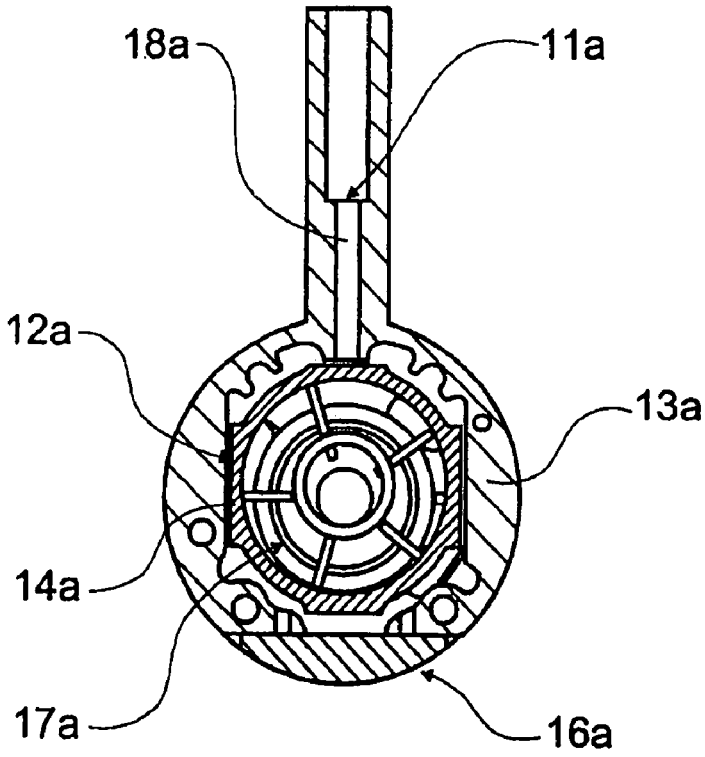
FIG. 2 shows a section through a controllable positive-displacement pump with an integrated adjusting device as shown in FIG. 1.

The throttle point 11*a* is arranged upstream of an adjusting piston 14*a* of steel, loaded by a compression spring 21*a*, of an actuating unit 15*a* of the pump unit 16*a*, via which actuating unit 15*a* the displacement volume of an adjustable vane pump 17*a* can be adjusted (FIGS. 1 and 2). The throttle point 11*a* is formed by a bore 18*a* in a pump housing 13*a* of aluminum. Instead of boring, the throttle point might also be formed in other ways which appear appropriate to a person skilled in the art, such as a casting method with cores, a milling process, etc.

The throttle point 12*a* is arranged downstream of the throttle point 11*a*, is connected to an oil sump 23*a* and is formed by a bearing gap between the pump housing 13*a* and the adjusting piston 14*a*. A pressure established between the throttle points 11*a*, 12*a* acts on the adjusting piston 14*a*.

The pump housing 13*a* and the adjusting piston 14*a* are made of different materials with different coefficients of thermal expansion, resulting in different thermal expansions during operation which are used to obtain a pressure difference.

As the temperature of the pressure medium rises the bearing gap increases and the throttle point 12*a* has, with increasing temperature of the pressure medium, a decreasing throttling effect as compared to the throttle point 11*a*, which is formed only from aluminum.

Additionally or alternatively to the bearing gap between the pump housing 13*a* and the adjusting piston 14*a*, the throttle point 12*a* might also be formed by consumers such as, in particular, bearings, which have a decreasing throttling effect with increasing temperature, for example, bearings of a differential, etc. In addition, the throttle point 11*a* might be so configured that it has an increasing throttling effect with increasing temperature, for example, by means of a bimetal element, or by electrical adjustment, etc.

With the internal combustion engine cold and the pressure medium cold, a high pressure, or control pressure, builds up at an early stage effective on the actuating unit 15*a*, because of the large throttling effect of the throttle point 12*a*, so that the adjusting piston 14*a* is moved toward the compression spring 21*a*. Instead of a compression spring 21*a*, other operating principles for producing an opposing force are in principle possible, such as hydraulic operating principles, etc. Early on, the displacement volume of the pump unit 16*a* is relatively small so that excessive pressure at low rotational speeds of the internal combustion engine, with the resulting power losses, are avoided. With the internal combustion engine hot and the pressure medium hot, the actuating pressure builds up only at relatively high speeds of the internal combustion engine, because of the small throttling effect of the throttle point 12*a* relative to the throttle point 11*a*, so that the displacement volume of the pump unit 16*a* is reduced only at relatively high engine speeds, being adapted to a viscosity change of the pressure medium. With the throttle point 11*a* undesired pressure fluctuations in the main oil passage 24*a* caused by the throttle point 12*a* can be reliably avoided.

Figure 3:
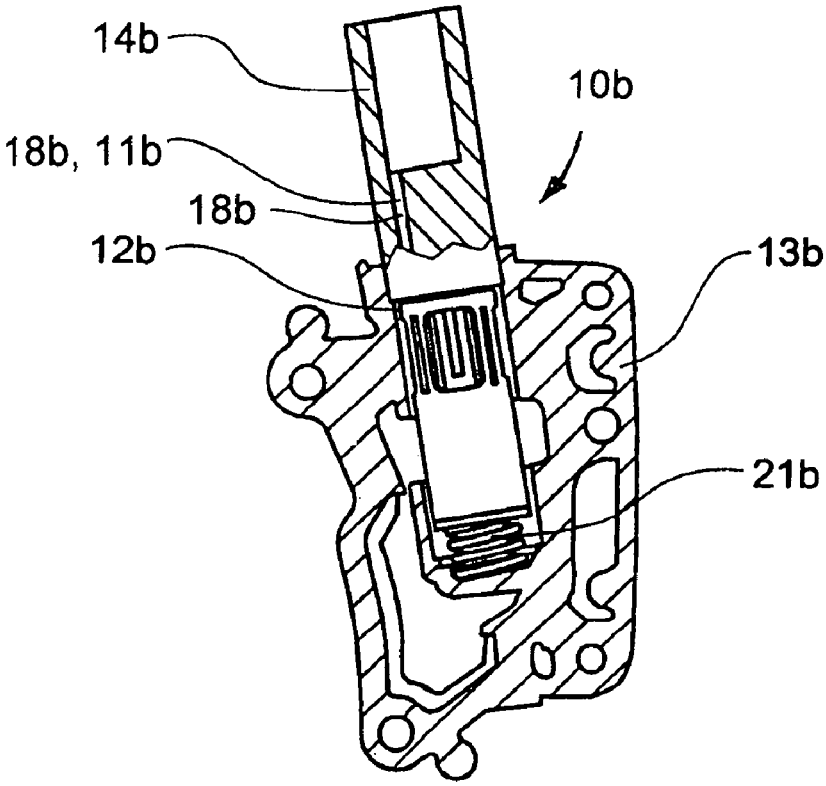
FIG. 3 shows a pressure control valve of an uncontrolled positive-displacement pump.

FIG. 3 shows an embodiment with an alternative adjusting device. In the description of the embodiments, substantially identical components and features are denoted in principle by the same references, the letters "a" and "b" being added to distinguish the embodiments. With regard to features and functions which remain the same, reference may also be made to the representation of the embodiments in FIGS. 1 and 2. The following description is restricted substantially to the differences with respect to the embodiment shown in FIGS. 1 and 2.

FIG. 3 shows a pressure control valve which has an adjusting piston 14*b* of steel in a pump housing 13*b* of aluminum of a positive-displacement pump with a constant displacement volume. The adjusting device again includes an adjusting unit 10*b* with a first and a second throttle point 11*b*, 12*b*, which have different dependences on a parameter formed by a temperature of the pressure medium, in order to obtain a pressure difference dependent on the parameter. Instead of being arranged in the pump housing 13*b* of the positive-displacement pump, a pressure control valve might also be arranged externally, that is, outside a pump housing.

The throttle point 11*b* is formed by a bore 18*b* in the adjusting piston 14*b*, while the throttle point 12*b* is formed by a bearing gap between the pump housing 13*b* and the adjusting piston 14*b*. As the temperature of the pressure medium rises the bearing gap increases, whereby the throttle point 12*b* has a decreasing throttling effect relative to the throttle point 11*b* with increasing temperature of the pressure medium. The throttle point 12*b*, like the throttle point 12*a*, is connected to an oil sump.

If the adjusting piston 14*b* is displaced against a compression spring 21*b*, a pressure passage of the positive-displacement pump is opened, the pressure medium is conducted by the pressure passage to a suction side of the positive-displacement pump and the displaced volume is therefore reduced.

As in the case of the adjusting device of FIGS. 1 and 2, in the case of the adjusting device according to FIG. 3 a displaced volume is limited at an early stage, i.e. at low engine speeds, when the internal combustion engine and pressure medium are cold, and excessive pressure at low speeds of the internal combustion engine, with resulting power losses, are avoided. When the internal combustion engine and the pressure medium are hot, a corresponding actuating pressure builds up only at relatively high speeds of the internal combustion engine because of the small throttling effect of the throttle point 12*b* relative to the throttle point 11*b*, so that the displaced volume is reduced only at relatively high speeds, for adaptation to viscosity changes of the pressure medium.

What is claimed is:

1. An adjusting device, in particular for a motor vehicle, comprising: an adjusting unit for adjusting a pressure of a pressure medium depending on at least one parameter, said adjusting unit including first and second throttle points which depend on said at least one parameter in different ways for obtaining a pressure difference dependent on said at least one parameter, and control means for adjusting the pressure of the pressure medium depending on said pressure difference, the at least one parameter being formed by a temperature of the pressure medium.

2. A system including an adjusting device as claimed in claim 1, further including a pump unit for providing the pressure medium.

3. The adjusting device as claimed in claim 2, wherein at least one throttle point is formed at least partially integrally with part of the pump unit.

4. The adjusting device as claimed in claim 1, wherein the throttle points are formed at least partially from different materials with different coefficients of thermal expansion resulting in different thermal expansions which, in operation, are used to determine the pressure difference.

5. The adjusting device as claimed in claim 1, wherein at least one of the throttle points is formed by a bearing gap between two components.

6. The adjusting device as claimed in claim 5, wherein the components are formed from materials with different coefficients of thermal expansion, and the resulting different thermal expansions in operation provide for the pressure difference.

* * * * *